United States Patent [19]

Leggett

[11] 4,236,602

[45] Dec. 2, 1980

[54] TREE STAND AND SEAT

[76] Inventor: Paul Leggett, 914 Woodville Dr., Jackson, Miss. 39212

[21] Appl. No.: 935,494

[22] Filed: Aug. 18, 1978

[51] Int. Cl.[2] ..... A45F 3/26

[52] U.S. Cl. ..... 182/187

[58] Field of Search ..... 182/187, 188, 133–136; 248/242, 291; 108/5, 6, 152, 188.7

[56] References Cited

U.S. PATENT DOCUMENTS

| | | | |
|---|---|---|---|
| 305,100 | 9/1884 | Moore | 182/187 |
| 2,746,705 | 5/1956 | McKinley | 248/188.7 |
| 3,065,821 | 11/1962 | Hundley | 182/187 |
| 3,730,294 | 5/1973 | Thurmond | 182/187 |
| 4,009,763 | 3/1977 | Hunter | 182/187 |
| 4,120,379 | 10/1978 | Carter | 182/187 |

FOREIGN PATENT DOCUMENTS

| | | | |
|---|---|---|---|
| 289384 | 3/1965 | Netherlands | 248/242 |
| 160345 | 3/1921 | United Kingdom | 287/100 |

*Primary Examiner*—Reinaldo P. Machado

*Attorney, Agent, or Firm*—Cushman, Darby & Cushman

[57] ABSTRACT

Apparatus attachable to a vertically extending object and having a stand and seat for providing support is disclosed. Means are provided for adjusting the pitch of the seat. Cables connected to the frame and the stand support much of the weight on the stand in order to provide stability. Both the seat and stand pivot so as to form a compact package for storage and portage. Means are provided for maintaining the apparatus noiseless both when the apparatus is flexed and when the seat and stand are pivoted. Other embodiments include only the seat and only the stand.

22 Claims, 5 Drawing Figures

10
12
14
16
30
32
34
36
38
40
42
44
46
48
50
52
54
55
56
57
58
59
60
62
64
66
68
70
72
74
76
78

TREE STAND AND SEAT

The present invention relates to apparatus for comfortably and safely supporting persons such as hunters adjacent to a vertically extending object for extended periods of time. More particularly, the present invention relates to such apparatus having a stand and/or a seat, which apparatus is easily portable and may be quickly and easily attached to the object, such as a tree.

Hunting from an elevated position results in many advantages. An elevated vantage point provides a much better view of the local area, so that game may be more easily spotted. Elevation into the foliage surrounded portion of a tree also provides a significant amount of camouflage, since game is much less likely to sense the presence of a hunter when the hunter is so elevated.

In a tree support used for hunting, the stand and seat should be of sturdy construction so that the apparatus easily holds the weight of at least one person without swaying. In addition, the stand and seat should be lightweight to permit easy portage both to and up the selected tree. The apparatus should also enable the easy and quick attachment to the tree.

Furthermore, it is particularly advantageous that the pitch of the seat be easily adjustable, and that the seat be designed to swing out of the way of a standing hunter. When a hunter sits upon the seat of such apparatus, his view of the surrounding area is rather limited. On the other hand, standing for an extended period may prove tiring. A seat pitch adjustment device, permitting the seat to vary in pitch between a position perpendicular to the tree and a position parallel to the tree solves this problem. The hunter may then select an appropriate seat pitch and rest upon the edge of the seat, thereby providing a much improved view of the surrounding area while still permitting the hunter to rest.

In addition, when the seat is at any particular pitch, and the hunter sights game, the hunter may wish to stand in order to get a better line of sight on the prey. Therefore, it is particularly advantageous if the seat readily swings to a position parallel to the tree, and out of the way of the hunter.

The tree support must not produce noises which may alert game in the area of the presence of the hunter. There are two aspects of this problem. First, the apparatus must remain noiseless when flexed by the movement of the hunter. Second, when the seat pitch is being adjusted, or when the seat is being moved to a position parallel to the tree and out of the way of the hunter, it would be inopportune for the seat to squeak.

Comfort is also a major consideration. If the stand and seat do not provide comfort for the hunter, the stand and seat fail to perform one of their major functions.

In addition to being lightweight, it is advantageous that the stand and seat fold into a relatively small package for easy portage. Carrying straps, appropriately positioned on the folded device, provide further convenience.

The prior art discloses a number of tree seats and tree stands, but none of them teach all of the advantageous features discussed above. The following patents disclose tree seats: U.S. Pat. No. 305,100 to Moore; U.S. Pat. No. 2,394,203 to Pruder; U.S. Pat. No. 2,991,842 to Hardin; U.S. Pat. No. 3,115,213 to Cloutier; U.S. Pat. No. 3,241,734 to Gray; U.S. Pat. No. 3,340,828 to Smith et al.; U.S. Pat. No. 3,392,802 to Moore; and U.S. Pat. No. 3,730,294 to Thurmond. None of the above-cited patents teach means for easily adjusting the pitch of the seat. In addition, many of the disclosed devices are not sturdy and would produce undesirable noises when flexed or folded.

U.S. Pat. No. 3,030,160 to Tandy discloses a hanging table which may superficially appear usable as a tree stand. However, the table as designed would not be sturdy enough to support a hunter.

The following patents disclose a tree stand with a seat: U.S. Pat. No. 3,358,789 to Laun; U.S. Pat. No. 3,419,108 to Mobbs; U.S. Pat. No. 3,485,320 to Jones. None of these references teach means for easily adjusting seat pitch, or teach a structure which provides all of the desirable features discussed above.

The present invention provides a structure to achieve all of the characteristics of a high quality tree support. A stand and a seat are pivotably attached to a vertical frame. Automobile-type belts and buckle, connected to the frame, permit the easy and quick attachment of the device to a tree. Means are provided for adjusting the pitch of the padded seat. The pivoting of the stand is limited by cables which support most of the weight placed on the stand in a manner that prevents the production of noise when flexed. These support cables are adjusted so that the pivoting of the stand is not limited by contact with the frame, thereby eliminating deformation over time, of either the stand or frame at the point of contact.

Nylon bushings at the point of pivoting of both the stand and the seat insure that the device remains noiseless when the seat or stand is pivoted. The seat and the stand pivot so that both may be positioned parallel to the frame to form a compact package for easy portage. Carrying straps are attached to the bottom of the stand so that the device may be carried on one's back. Other embodiments of the invention disclose a tree support with only a stand and with only a seat. In the tree seat embodiment of the invention, a back rest is provided to further increase the comfort of the hunter.

These and other objects and advantages of the invention will become more apparent and more readily appreciated from the following detailed description of the presently preferred exemplary embodiment of the invention taken in conjunction with the accompanying drawings, of which:

Figure 1:
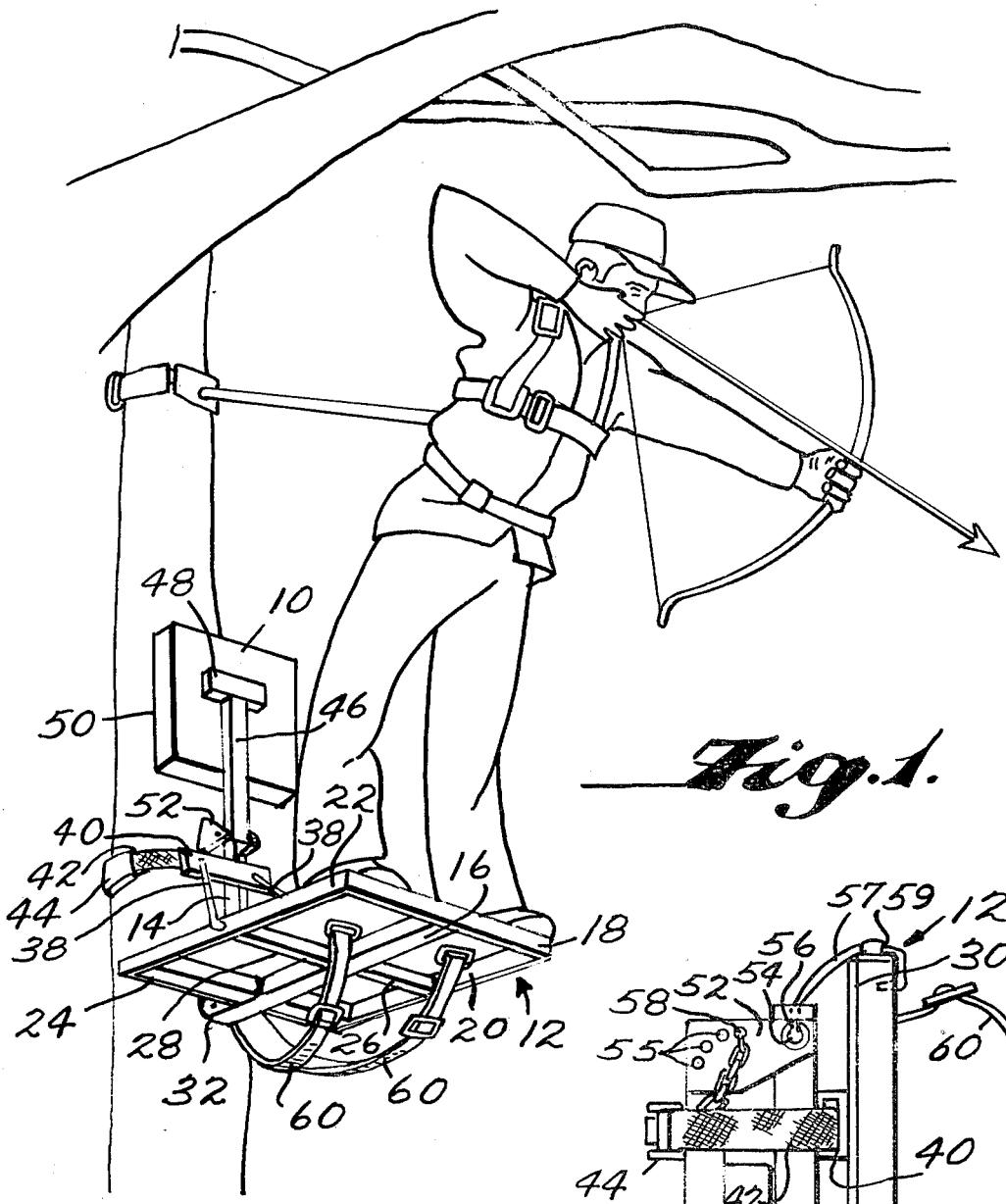
FIG. 1 is a perspective view from below of one embodiment of the tree support.
Figures 2, 4, 5:
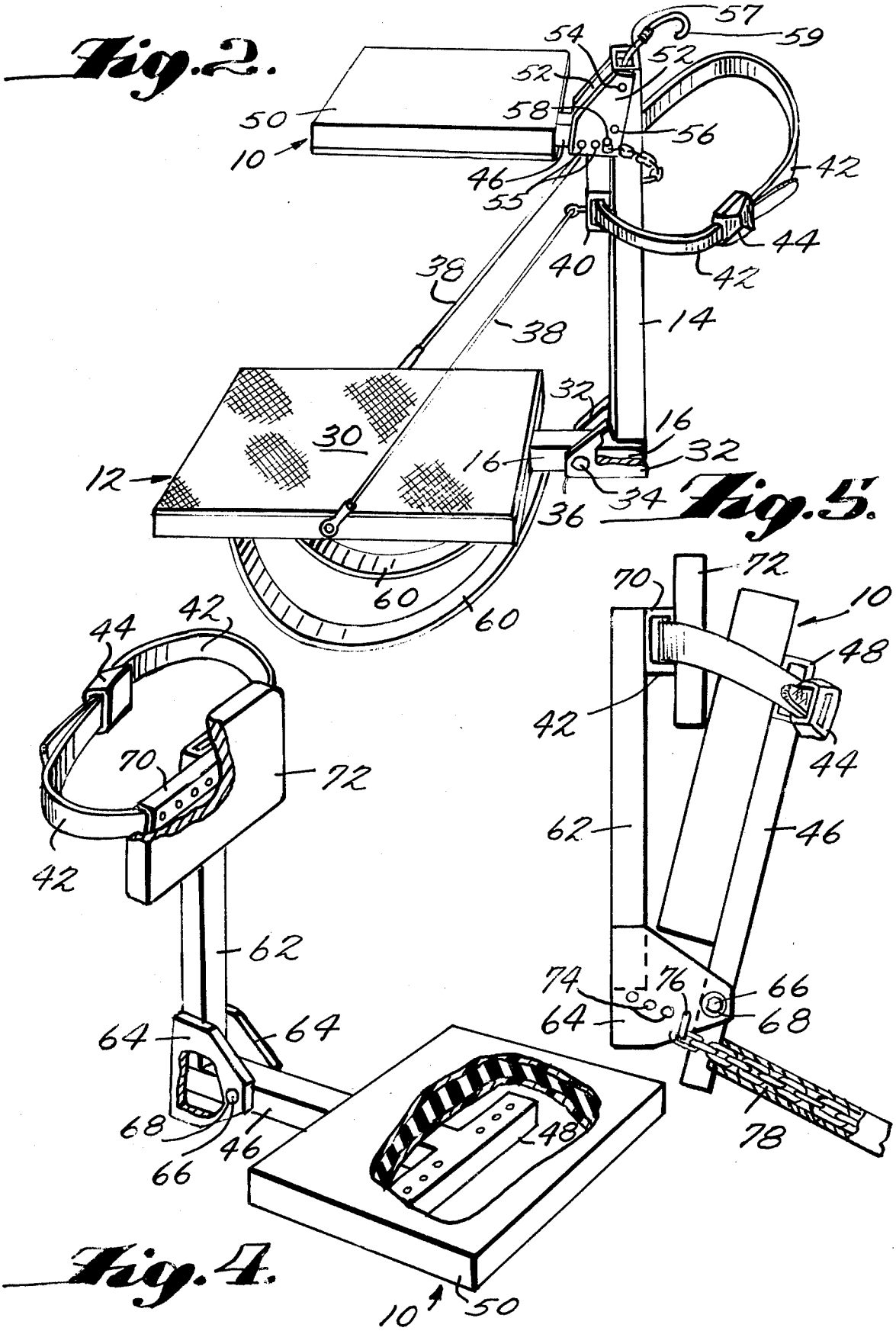
FIG. 2 is a perspective view from above of the tree support of FIG. 1.
FIG. 4 is a perspective view of a second embodiment of the tree support.
FIG. 5 is a side elevational view of the tree support of FIG. 4 in folded position.

In FIGS. 1 and 2, seat 10 and stand 12 are attached to frame means 14. Vertical frame 14 is tubular aluminum with a one inch by two inch rectangular cross-section.

As is best illustrated in FIG. 1, stand 12 is comprised of supports 16, 18, 20, 22, 24, 26, and 28, which, in the preferred embodiment, are all welded together in the illustrated pattern. In the preferred embodiment, support 16 is tubular aluminum having a one inch by two inch rectangular cross-section, while the remaining supports are tubular aluminum having one inch square cross-sections. Cover 30, made of expanded aluminum, is welded to the supports.

Stand attaching means such as brackets 22 are preferably welded to frame 14. Support 16 is attached to bracket 32 via stainless steel bolt 34. The hole in support 16, through which bolt 34 is placed, is positioned in such a way that when stand 12 is perpendicular to frame 14, support 16 extends nearly to the side of bracket 32 nearest the tree to which the device is attached. In order to insure that stand 32 pivots noiselessly, nylon bushings 36 are provided about the holes in bracket 32 and support 16.

To support and limit the pivoting of stand 12, flexible one-eighth inch galvanized stranded cables 38 are connected to frame 14 and stand 12 by any standard method well known in the art. Steel cables 38 aid in maintaining the device noiseless when flexed. Cables 38 are of such a length that when stand 12 is in a work position, substantially perpendicular to frame 14, and weight is placed on stand 12, support 16 does not touch frame 14 (see FIG. 2). As is well known, the compression strength of aluminum is fairly low. If support 16 were permitted to contact frame 14, deformation would occur over time, thereby affecting the angular orientation of stand 12 to frame 14. Thus, cable 38 and bolt 34 support all of the weight placed upon stand 12.

Welded to frame 14 is tree attachment support 40. One end of each of belts 42 are attached to tree attachment support 40, the other ends of which may be quickly and easily fastened together with buckle 44. In the preferred embodiment, belts 42 and buckle 44 are automobile seat belt type belts and buckle, providing quick and efficient means for fastening the device to a tree and adjusting the length of the belts.

Seat 10 is supported by seat support 46 and support 48, preferably welded to support 46. Both supports 46 and 48 are tubular aluminum, in the preferred embodiment, having a one inch by two inch rectangular cross-section. Seat cushion 50 comprises a vinyl covered foam rubber cushion mounted on plywood. The plywood is attached to supports 46 and 48 by means of screws.

Welded to support 46 are seat attaching means such as brackets 52. Brackets 52 are pivotably attached to frame 14 by means of stainless steel bolt 54. Nylon bushings 56 (see FIG. 3), positioned about the holes in brackets 52 and frame 14, permit the noiseless pivoting of brackets 52 and seat 10. Brackets 52 are mounted to frame 14 in such a way that seat 10 may pivot between a work position perpendicular to frame 14 and on the same side of frame 14 as stand 12, and a storage position parallel and proximate to frame 14 and on the opposite side of frame 14 from stand 12 (see FIG. 3).

The pitch of seat 10 may be adjusted by means of pairs of holes 56 in brackets 52 (one of each pair being in each of brackets 52, respectively) and pin 58. When pin 58 is positioned within a particular pair of holes 56, the downward angular rotation of seat 10 is limited, thereby controlling the adjustment of seat pitch. By changing the pair of holes in which pin 58 is inserted, various seat pitch limitations are obtainable.

Figure 3:
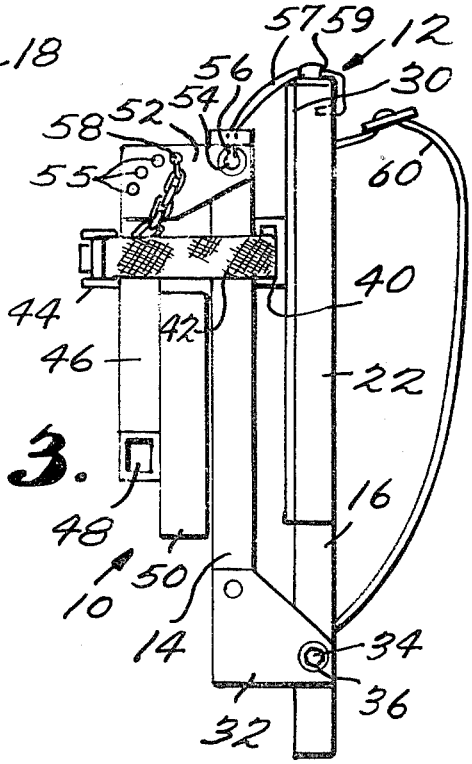
FIG. 3 is a side elevational view of the tree support of FIG. 1 in folded position.

As illustrated in FIG. 3, for storage and easy portage, seat 10 and stand 12 may be pivoted from a work position to a storage position parallel and proximate to frame 14, forming a compact package. Belts 42 and buckle 44 may be connected around the package in order to hold the assembly stable. Adjustable straps 60 are attached to the bottom of stand 12 in a conventional manner. Strap 60 may be placed over the shoulders so that the entire unit may be carried on one's back while allowing complete freedom of the hands for hunting or climbing.

An alternative embodiment of the present invention is the tree support without the seat. This embodiment is also illustrated in FIGS. 1, 2 and 3, since the only difference between this embodiment and the previously discussed embodiment is that seat assembly 10 would not be included.

FIGS. 4 and 5 illustrate still another embodiment of the tree support having only a seat. Since the structure is similar to the seat structure of the embodiment illustrated in FIGS. 1, 2 and 3, like elements have been numbered similarly. Thus, brackets 46 and 48 and cushion 50 in FIGS. 4 and 5 are similar to brackets 46 and 48 and cushion 50 in FIGS. 1, 2 and 3.

Seat attaching means such as brackets 64 are welded to frame 62. Frame 62 is preferably tubular aluminum having a one inch by two inch rectangular cross-section. Support 46 is pivotably mounted to bracket 64 by means of stainless steel bolt 66. Nylon bushing 68, about the holes in bracket 64 and support 46 permit the noiseless pivoting of seat 10.

Back support bar 70, preferably of tubular aluminum with a one by two inch cross-section is welded to frame 62. Back-rest 72, comprising vinyl covered foam cushion mounted on a plywood board, is attached to back support bar 70 by means of screws. Belts 42 and buckle 44 are attached to back support bar 70 in a manner similar to belts 42 and buckle 44 of the embodiment illustrated in FIGS. 1, 2 and 3.

Pairs of holes 74 (one of each pair being in each of brackets 64, respectively) and tilt pin 76 provide means for adjusting the pitch of seat 10. The placement of tilt pin 76 in one of the pairs of holes 74 limits the downward rotational position of seat 10, thereby controlling its pitch. By changing the holes in which tilt pin 76 is inserted, the pitch of seat 10 may be varied.

For storage and easy portage, seat 10 may be pivoted upward so that it is proximate to frame 62 and back rest 72. Belts 42 and buckle 44 may be fastened around seat 10 to hold it in position. Pin 76 may then be inserted in holes as illustrated in FIG. 5, locking seat 10 in the storage position. Vinyl covered chain 78, having one end connected to pin 76 and the other end connected to bracket 64 (connection not shown), may then be utilized as a carrying handle.

In all of the embodiments described above, the aluminum used is one-eighth inch thick 6063 alloy. This provides a lightweight structure capable of suppporting the necessary weight. For example, the embodiment illustrated in FIGS. 1, 2 and 3 weighs thirteen pounds and can easily support five hundred pounds.

Although only a few exemplary embodiments of this invention have been described in detail above, those skilled in the art will readily appreciate that many modifications are possible in the exemplary embodiments without materially departing from the novel teachings and advantages of this invention. For example, supports of different material and organized in a different fashion may be utilized within this scope of the teachings and advantages of this invention. Accordingly, all such modifications are intended to be included within the scope of this invention as defined in the following claims.

What is claimed is:

1. A combination stand and seat structure attachable to a vertically extending object comprising:

frame means;

means for removably attaching said frame means to said object;

a stand;

stand attaching means for pivotably attaching said stand to said frame means;

a seat;

a seat attaching means for pivotably attaching said seat to said frame means; and means for selectively adjusting the pitch of said seat relative to said frame means, said pitch adjusting means being pivotably attached to said frame means.

2. Apparatus as in claim 1 wherein:

said stand attaching means comprises stand bracket means for pivotably attaching said stand to said frame means, said stand attaching means for limiting the pivoting of said stand between a storage position parallel and proximate to said frame means and a work position; and said seat attaching means comprises means for pivotably attaching said seat to said frame means and for limiting the pivoting of said seat between a work position and a storage position parallel to said frame means on the side of said frame means opposite said stand, so that said stand and said seat may be positioned parallel and proximate to said frame means for easy portage.

3. Apparatus as in claim 2 further comprising carrying straps attached to said stand so that when said stand and seat are folded parallel and proximate to said frame means, said stand comprises a pack frame permitting said apparatus to be easily carried by said straps.

4. Apparatus as in claim 1 wherein said stand attaching means comprises:

a support attached to and extending from said stand;

a stand bracket rigidly attached to said frame means;

means for pivotably attaching said stand extending support to said frame means; and stand pivot limiting means for limiting the pivoting of said stand between a storage position and a work position, said pivot limiting means prohibiting the direct contact of said frame means and said stand extending support when said stand is in said work position, and weight is applied to said stand.

5. Apparatus as in claim 4 wherein said stand pivot limiting means comprises a pair of flexible cables each having one end attached to said frame means and each having the other end attached to opposite sides of said stand for limiting the pivoting of said stand between a storage position and a work position, said pair of cables being of such a length that said stand extending support does not directly contact said frame means when said stand is in said work position and weight is applied to said stand.

6. A stand and seat combination attachable to a vertically extending object comprising:

frame means;

means for removably attaching said frame means to said object;

a stand, having a support extending therefrom;

stand bracket means for pivotably interconnecting said stand extending support and said frame means;

stand support means for limiting the pivoting of said stand between a storage position parallel and proximate to said frame means and a work position substantially normal to said frame means, and prohibiting said stand extending support from directly contacting said frame means when said stand is supported in said work position and weight is applied to said stand;

a seat; and seat attaching means for attaching said seat to said frame means.

7. A stand and seat combination attachable to a vertically extending object comprising:

frame means;

means for removably attaching said frame means to said object;

a stand;

stand attaching means for pivotably attaching said stand to said frame means and for limiting the pivoting of said stand between a storage position parallel and proximate to said frame means and a work position;

a seat; and seat attaching means for pivotably attaching said seat to said frame means and for permitting the pivoting of said seat between a work position and a storage position parallel and proximate to said frame means, so that said stand and said seat may simultaneously be folded parallel and proximate to opposite sides of said frame means for efficient portage.

8. Apparatus attachable to a vertically extending object for providing support comprising:

frame means;

means for removably attaching said frame means to said object;

a stand;

stand attaching means for pivotably attaching said stand to said frame means, said stand attaching means comprising nylon gushings permitting said stand to pivot noiselessly;

a seat; and bracket means for pivotably attaching said seat to said frame means, said seat attaching means comprising nylon bushings permitting the noiseless pivoting of said seat; and stand support means for limiting the pivoting of said stand between a storage position and a work position, and prohibiting said stand from directly contacting said frame means when said stand is supported in said work position and weight is applied to said stand.

9. Apparatus as in claim 8 wherein:

said noiseless pivoting means comprises nylon bushings; and said apparatus further comprises means for maintaining said apparatus noiseless when said apparatus is flexed.

10. Apparatus as in claims 7 or 8 further comprising means for adjusting the pitch of said seat relative to said frame means.

11. Apparatus as in claim 10 wherein said seat pitch adjusting means comprises:

a seat support extending from said seat;

seat bracket means rigidly attached to said seat extending support and having a plurality of pairs of holes;

means for pivotably attaching said seat bracket means to said frame means; and a tilt pin, said pin capable of being selectively positioned through one of said seat bracket means pairs of holes, said pairs of holes being positioned so that when weight is applied to said seat, said tilt pin rests against said frame means to thereby adjust the pitch of said seat.

12. A stand and seat combination attachable to a pole-like object comprising:

frame means;

two flexible belts, one end of each attached to said frame means;

release and connection means for releasably connecting together the other ends of said two belts and for permitting belt adjustment after the apparatus has been attached to said pole-like object, said two belts and release and connection means cooperating for the attachment of said frame means to said object;

a stand, having a support extending therefrom;

a stand bracket rigidly attached to said frame means;

means for pivotably attaching said stand to said frame means, comprising means for pivotably interconnecting said stand bracket and said stand extending support and bushing means for permitting noiseless pivoting of said stand;

stand pivot limiting means comprising a pair of flexible support members each having one end attached to said frame means and each having the other end attached to opposite sides of said stand for limiting the pivoting of said stand between a storage position parallel and proximate to said frame means and a work position on the same side of said frame means as when said stand is in said storage position, the length of said pair of support members and said bracket prohibiting said stand extending support from directly contacting said frame means when said stand is in said work position and weight is applied to said stand;

a seat having a support extending therefrom;

a seat bracket rigidly attached to said seat extending support and having a pluralty of pairs of holes;

means for pivotably attaching said seat to said frame means comprising means for pivotably interconnecting said seat bracket and said seat extending support and nylon bushing means for permitting the noiseless pivoting of said seat, said seat attaching means limiting the pivoting of said seat between a work position perpendicular to said frame means on the same side of said frame means as said stand and a storage position parallel to said frame means on the side of said frame means opposite said stand;

means for adjusting the pitch of said seat comprising a tilt pin, said pin capable of being selectively inserted through one of said seat bracket pairs of holes, said pairs of holes being positioned so that when weight is applied to said seat, said tilt pin rests against said frame means to thereby adjust the pitch of said seat;

carrying straps attached to said stand so that when said stand is folded parallel and proximate to one side of said frame means, and said seat is folded parallel and proximate to the opposite side of the frame means said apparatus may be easily carried by said straps; and means for maintaining said apparatus noiseless when said apparatus is flexed.

13. A stand attachable to a vertically extending object comprising;

frame means;

means for removably attaching said frame means to said object;

a stand, having support extending therefrom; and bracket means for pivotably interconnecting said stand extending support and said frame means;

stand support means for limiting the pivoting of said stand between a storage position parallel and proximate to said frame means and a work position substantially normal to said frame means, and prohibiting said stand extending support from directly contacting said frame means when said stand is supported in said work position and weight is applied to said stand.

14. Apparatus as in claim 13 wherein said stand attaching means permits the pivoting of said stand, and said stand attaching means further comprises means for permitting the noiseless pivoting of said stand.

15. Apparatus as in claim 16 or 19, further comprising carrying straps attached to said stand so that said stand forms a pack frame when said stand is in said storage position so that said apparatus may be easily carried by said straps.

16. A stand attached to a vertically extending object comprising:

frame means;

means for removably attaching said frame means to said object;

a stand;

bracket means for pivotably interconnecting said stand and said frame means, said stand attaching means including bushing means permitting said stand to pivot noiselessly; and stand support means for limiting the pivoting of said stand between a storage position and a work position, and prohibiting said stand from directly contacting said frame means when said stand is supported in said work position and weight is applied to said stand.

17. Apparatus as in either claim 14 or 16 wherein:

said noiseless pivoting means comprises nylon bushings; and said apparatus further comprises means for maintaining said apparatus noiseless when said apparatus is flexed.

18. A stand attachable to a pole-like object comprising:

frame means;

two belts, one end of each attached to said frame means;

release and connection means, for releasably connecting together the other ends of said two belts, said two belts and release and connection means cooperating for the attachment of said frame means to said object;

a stand, having a support extending therefrom;

a stand bracket rigidly attached to said frame means;

means for pivotably attaching said stand to said frame means, comprising means for pivotably interconnecting said stand bracket and said stand extending support and nylon bushing means for permitting the noiseless pivoting of said stand;

stand pivot limiting means comprising a pair of flexible cables each having one end attached to said frame means and each having the other end attached to opposite sides of said stand for limiting the pivoting of said stand between a storage position parallel and proximate to said frame means and a work position on the same side of said frame means as when said stand is parallel to said frame means, the length of said pair of cables and said bracket prohibiting said stand extending support from directly contacting said frame means when said stand is in said work position and weight is applied to said stand;

carrying straps attached to said stand so that when said stand is parallel and proximate to said frame means, said apparatus may be easily carried by said straps; and means for maintaining said apparatus noiseless when said apparatus is flexed.

19. A seat attachable to a vertically extending object comprising:

frame means;

means for removably attaching said frame means to said object;

a seat;

seat attaching means for pivotably attaching said seat to said frame means, said seat attaching means including bushing means for permitting the noiseless pivoting of said seat; and means for selectively adjusting the pitch of said seat relative to said frame means, said pitch adjusting means being attached to said frame means.

20. A seat attachable to a pole-like object comprising:

frame means;

two belts, one end of each attached to said frame means;

buckle means, for connecting together the other end of said two belts, said two belts and buckle means cooperating for the attachment of said frame means to said object;

a seat having a support extending therefrom;

a seat bracket means rigidly attached to said seat extending support and having a plurality of pairs of holes;

means for pivotably attaching said seat to said frame means comprising means for pivotably interconnecting said seat bracket means and said seat extending support and nylon bushing means for permitting the noiseless pivoting of said seat, said seat attaching means limiting the pivoting of said seat between a work position perpendicular to said frame means and a storage position parallel to said frame means on the same side of said frame means;

means for adjusting the pitch of said seat attached to said frame means comprising a tilt pin, said pin capable of being selectively positioned through one of said seat bracket means pairs of holes, said pairs of holes being positioned so that when weight is applied to said seat, said tilt pin rests against said frame means to ghereby adjust the pitch of said seat.

21. A seat attachable to a vertically extending object comprising:

frame means;

means for removably attaching said frame means to said object;

a seat;

seat attaching means for attaching said seat to said frame means; and means for selectively adjusting the pitch of said seat relative to said frame means, said pitch adjusting means being attached to said seat attaching means.

22. Apparatus as in either claims 19 or 21 wherein the means for adjusting the pitch of said seat comprises a tilt pin, said pin capable of being selectively positioned through one of several pairs of holes in said seat bracket means, said pairs of holes being positioned so that when weight is applied to said seat, said tilt pin rests against said frame means to thereby adjust the pitch of said seat.

* * * * *